United States Patent [19]

Watts

[11] Patent Number: 4,580,616

[45] Date of Patent: Apr. 8, 1986

[54] METHOD AND APPARATUS FOR CONTROLLED SOLIDIFICATION OF METALS

[75] Inventor: Leonard Watts, North Miami Beach, Fla.

[73] Assignee: Techmet Corporation, Greenwich, Conn.

[21] Appl. No.: 447,288

[22] Filed: Dec. 6, 1982

[51] Int. Cl.[4] ..... B22D 11/18; B22D 18/08; B22D 35/06; B22D 46/00

[52] U.S. Cl. ..... 164/457; 164/119; 164/122; 164/133; 164/155; 164/453; 164/455; 164/900

[58] Field of Search ..... 164/122, 133, 900, 457, 164/453, 455, 155, 119

[56] References Cited

U.S. PATENT DOCUMENTS

| | | | |
|---|---|---|---|
| Re. 30,979 | 6/1982 | Watts | 164/122 X |
| 2,891,294 | 6/1959 | Muller et al. . | |
| 2,978,764 | 4/1961 | Hrabovsky . | |
| 3,191,292 | 6/1965 | Strom . | |
| 3,417,810 | 12/1968 | Tiskus et al. . | |
| 3,517,725 | 6/1970 | Watts . | |
| 3,570,713 | 3/1971 | Tromel | 164/122 X |
| 3,680,624 | 8/1972 | Watts . | |
| 3,814,166 | 6/1974 | Watts . | |
| 3,868,988 | 3/1975 | Hansson et al. . | |
| 3,902,544 | 9/1975 | Flemings et al. | 164/122 X |
| 3,948,650 | 4/1976 | Flemings et al. . | |
| 3,954,455 | 5/1976 | Flemings et al. . | |
| 4,100,960 | 7/1978 | Watts . | |
| 4,434,839 | 3/1984 | Vogel | 164/122 X |

FOREIGN PATENT DOCUMENTS

| | | |
|---|---|---|
| 1543206 | 3/1979 | United Kingdom . |
| 2037634A | 7/1980 | United Kingdom . |
| 2051597A | 1/1981 | United Kingdom . |

OTHER PUBLICATIONS

A. A. Tzavaras, "Solidification Under Induced-Fluid--Flow and Continuous Casting", Proceedings of the Continuous Casting Symposium of the 102 AIME Annual Meeting, 1973, pp. 198-214.

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A molten metal treatment apparatus comprising a passage of predetermined size and length for receiving superheated molten metal from a source thereof, and for supplying the molten metal for subsequent casting; a gas inlet and a control valve for controlling the velocity of the molten metal through the passage by exposing the molten metal to a source of pressurized gas; a cooling jacket at least partially surrounding the passage for controlling the temperature of the molten metal within the passage between predetermined upper and lower limits for forming a thin solidified shell having a molten metal core within the passage; the combination of the velocity of molten metal and the temperature of the molten metal within the passage for allowing dendrites to grow into the molten core from the solidified shell, and for breaking off portions of the dendrites and entraining them in the molten metal thereby producing a solids content within the molten metal for subsequent casting. A method for producing a partial solids content within a molten metal stream for subsequent casting including the steps of flowing molten metal at a controlled velocity through a passage of predetermined area to length ratio and cooling the passage at a controlled rate to form dendrites on the inner surface of the passage.

9 Claims, 7 Drawing Figures

METHOD AND APPARATUS FOR CONTROLLED SOLIDIFICATION OF METALS

FIELD OF INVENTION

This invention relates to the solidification of metals, and more specifically to an apparatus and method for producing a solids content within a molten metal for subsequent casting into ingots, bars and useful shapes.

BACKGROUND OF THE INVENTION

The solidification of molten metal is a dynamic process which is not fully understood, despite years of experimentation. In conventional casting technology, molten metal which has been heated to a temperature above its liquidus point is poured into a mold. Depending upon the particular casting process being utilized and the type of metal itself, varying amounts of superheat are required in order to insure that the metal will remain in a liquid state and therefore, flowable, during the casting or mold filling operation. The superheat, that amount of heat which causes the molten metal to exceed its liquidus temperature, begins to dissipate as soon as the molten metal is separated from the heat source. In recent years, industrial casting processes have tended to operate with as little superheat as possible, not only for energy conservation purposes, but for quality improvement. In all but the rarest cases, low superheat in the mold improves quality by reduced segregation, less shrinkage, lower gas content and other qualitative aspects. Unfortunately, the need for little or no superheat in the mold conflicts with the requirement for flowability during the mold filling phase. Therefore all commercial casting processes operate with some amount of superheat.

Because of the large amount of heat typically present in a molten metal, solidification normally takes place more slowly than would be desired. The mold absorbs heat from the molten metal and dissipates that heat to the surrounding atmosphere, often with an assist from some cooling apparatus. The outer surface of the molten metal adjacent to the mold loses its superheat most rapidly, and a solidifying metal shell quickly forms on the inner surface of the mold. However, the rate of heat loss between the liquidus and solidus temperatures of the metal is much slower than the rate of heat loss above liquidus or below solidus. Thus, the metal is at a temperature between liquidus and solidus for an extended period during solidification. It is during this time period that large dendrites begin to form at the liquid-solid interface.

Essentially all metals solidify by dendritic growth. Dendrites are "tree like" particles of solidifying metal which "grow" on the inner surface of the solidifying metal shell from the solid toward the liquid phase. In a static mold system, dendritic growth progresses from the coolest part of the system inward toward the hotter portion, and the solidification rate decreases exponentially as the shell thickens. This causes the growth of increasingly larger sized dendrites resulting in undesirably large sized grains in the solidified casting.

Castings often exhibit an undesireable characteristic called "piping" in which a continuous void is formed in the solidifying ingot or shape. Piping is caused by "bridging" of the dendrites across the final shrinking liquid core of the casting. The bridge is caused by a combination of thermal gradients and chemical segregation.

During solidification, the liquid phase of the metal is usually enriched in solute elements such as carbon, silicon, manganese, etc., by rejection of these elements from the solidifying phase into the liquid phase. This enriched liquid has a lower solidus temperature than the nominal composition of the melt, and will therefor solidify last.

Transverse temperature gradients can exist along the longitudinal centerline due to the shape of the casting or non-uniform cooling. These temperature differences can effect localized chemical composition and therefore alter the solidification temperature within a given region. Those regions will tend to "bridge", and "piping" will be formed between the bridges. These bridges block the flow of liquid metal resulting in centerline porosity or other voids in the solidified casting, which can seriously effect the strength and reliability of the final product.

Other problems in conventional casting can result from "inclusions" which become entrained in the melt. Inclusions are nonmetallic particles of a ceramic nature some of which are picked up from the furnace, ladle or any refractory surface with which the liquid comes into contact. Another source of nonmetallics is from elements in the liquid metal which combine with oxygen and nitrogen to form oxide and nitride compounds such as aluminium oxide ($Al_2O_3$), various silica and manganese oxides. Other sources are from reactive elements which are added intentionally to reduce the oxygen and nitrogen content or otherwise impart specific properties to the metal. Sulphur, which is always present, even in trace amounts, may give rise to various sulphide compounds. These materials are extremely harmful to steel.

These inclusions have lower density than most liquid metal, and will float toward the upper surface. If the inclusions tend to stratify, (form a large grouping in one plane) a plane of weakness occurs which may result in failure of the finished part.

The importance of fluid flow in the control of solidification has been recognized for some time. Numerous devices are available for imparting motion to the liquid phase of solidifying metal along a solid/liquid interface during casting, including electromagnetically induced fluid flow and rotary stirring. These devices attempt to inhibit the growth of larger columnar dendrites, improve dispersion of chemical solutes, inhibit stratification of inclusions and reduce central porosity. It has been demonstrated that when the liquid phase of a solidifying casting is subjected to rapid motion, the grain structure will become modified. This modification can result in a reduction in grain size, shape and orientation as well as a decrease in chemical segregation. Non-metallics become more uniformly distributed and greater central soundness is achieved. Thermal gradients, magnetic coils, mechanical vibration and stirring have all been used in the prior art for the purpose of imparting motion to the liquid core. In general, prior art attempts to control solidification have required costly and cumbersome machinery to create fluid flow within the mold.

My prior U.S. Pat. No. Re 30,979, reissued on June 22, 1982, discloses a method and apparatus which partially solves the above problems by controlling the velocity of molten metal in a tubular mold to sweep the solid/liquid interface and thereby inhibit or reduce columnar dendritic growth. In that patent, an externally cooled inclined mold is supplied with molten metal at a controlled velocity. The velocity is such that the molten metal shears or breaks off the dendrites growing at the solid/liquid interface and entrains them in the molten metal eventually forming a slurry of dendritic particles and liquid metal. The final solidification of this slurry takes place rapidly avoiding piping and segregation, and producing an elongated bar having a finer grain structure than could be achieved by conventional techniques.

However, the invention disclosed and claimed in my reissue patent, discussed above, utilizes only elongated molds having a specified range of dimensions.

I have now applied the principles of my reissue U.S. Pat. No. 30,979, to achieve a further improvement in the quality of castings, and to provide more flexibility in the size, shape and type of castings which may be formed utilizing these principles.

It is a primary object of the present invention to thermally precondition molten metal to produce a molten metal slurry having a solids content for subsequent casting.

It is another object of the invention to control the rate of solidification of molten metal without the need for complex machinery.

Another object of the invention is to produce a slurry of molten metal generally having a temperature between the liquidus and solidus temperatures of the metal for subsequent casting into molds of varying shape.

SUMMARY OF THE INVENTION

To achieve the foregoing objects and in accordance with the purpose of the invention as embodied and broadly described herein, the molten metal treatment apparatus of this invention comprises passage means of predetermined size for receiving superheated molten metal from a source thereof, and for supplying the molten metal for subsequent casting; means for controlling the velocity of the molten metal through the passage means; and cooling means at least partially surrounding the passage means for maintaining the temperature of the molten metal within the passage means between predetermined upper and lower limits, the passage means having a cooled inner surface. The combination of the velocity of molten metal and the temperature of the molten metal within the passage means is for allowing dendrites to grow into the molten core from the cooled inner surface, and for breaking off portions of the dendrites and entraining them in the molten metal thereby inducing a solids content within the molten metal for subsequent casting.

Preferably, the passage means includes an inlet port and an outlet port, and the velocity controlling means includes pressure means for regulating the flow of molten metal through the outlet port.

The passage means preferably comprises a copper tube having a plurality of radially extending fins on the outer surface thereof for enhancing heat transfer from the copper tube.

It is also preferred that the cooling means include a steel jacket surrounding the copper tube for circulating coolant about the copper tube. Temperature sensing devices are preferably mounted at an entrance and an exit of the jacket for measuring the extrance and exit coolant temperatures.

The process of the present invention broadly comprises the steps of flowing superheated molten metal at a controlled velocity into a passage of predetermined size and length, and cooling the passage for forming a solidified shell having a molten metal core within the passage. The combination of the velocity of molten metal and the cooling rate is for allowing dendrites to grow into the molten core from the solidified casting shell, and for breaking off portions of the dendrites and entraining them in the molten metal, thereby developing a solids content within the molten metal for subsequent casting. Preferably, the temperature of the molten metal exiting the passage is maintained between the liquidus and solidus temperatures of the metal.

BRIEF DESCRIPTION OF THE DRAWINGS

The accompanying drawings which are incorporated in and constitute a part of this specification, illustrate several embodiments of the invention and, together with the description, serve to explain the principles of the invention.

Of the Drawings

DESCRIPTION OF THE PREFERRED EMBODIMENTS

Reference will now be made in detail to the present preferred embodiments of the invention, examples of which are illustrated in the accompanying drawings.

Figure 2:
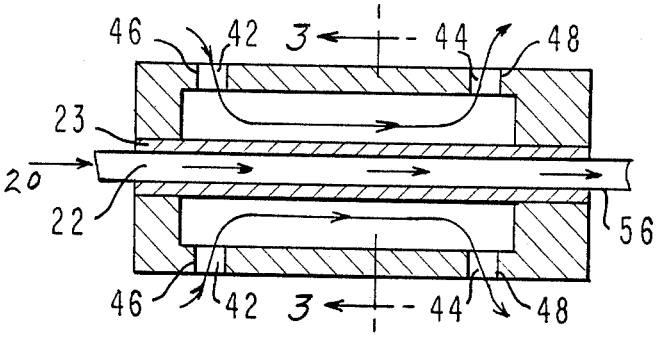
FIG. 2 is an enlarged view of the passage means and cooling jacket of the embodiment of FIG. 1.
Figure 1:
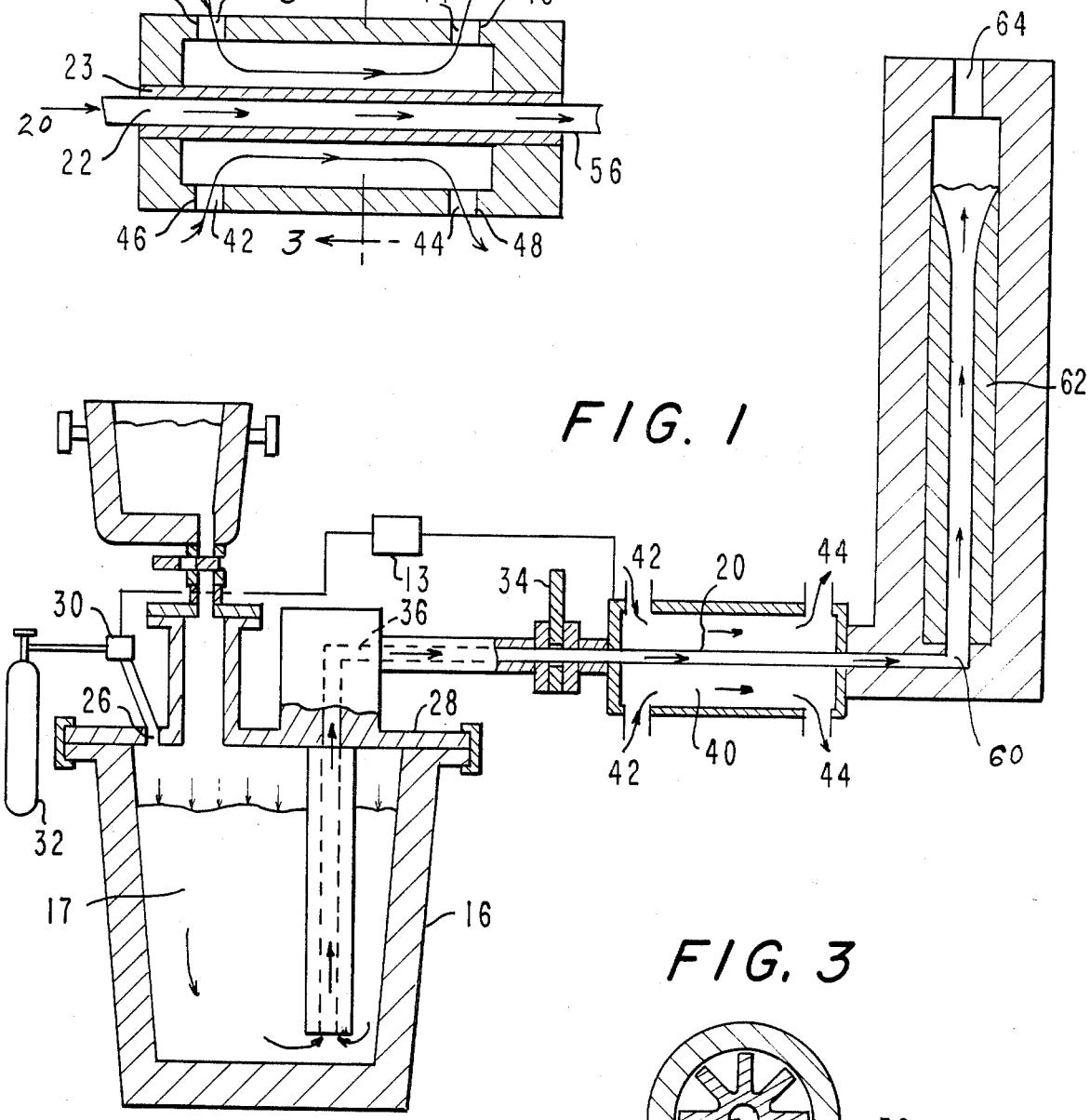
FIG. 1 is a diagram of one embodiment of the apparatus of the present invention.

As shown in FIGS. 1 and 2, the invention is an apparatus and method for treating molten metal to provide a slurry thereof for subsequent casting. In accordance with the invention, passage means of predetermined size and length are provided for receiving superheated molten metal from a source thereof, and for supplying the molten metal slurry for subsequent casting. As embodied herein, the source of molten metal may be a conventional furnace such as a coreless induction furnace, or arc furnace, or the metal may be provided by an A.O.D. vessel or any other suitable means. The superheated metal produced in the furnace may be fed directly to the apparatus of the invention, or may be transferred to such apparatus by means of a transportable ladle, or other suitable means. To achieve the molten metal velocities necessary for operation of the invention, it is preferable that the molten metal be supplied to the passage means by gas pressurization, however, gravity means could be utilized if desired.

The source of molten metal may comprise a preheated vessel 16 as shown in FIG. 1. Vessel 16 may be filled from a transfer ladle, or directly from the furnace or source of molten metal. The vessel 16 is then sealed and subsequently pressurized, by gas, at a predetermined rate. The gas pressure causes the superheated liquid metal to flow from the vessel 16 into the apparatus of the invention.

As embodied herein, the passage means of the present invention comprises a liquid metal flow path 20 which is coupled to the pressurized vessel 16. This flow path 20 receives superheated molten metal from the vessel 16, and supplies that metal for subsequent casting. The flow path 20 preferable comprises a cylindrical sleeve 22 having an inner surface 23 formed of copper.

Figure 7:
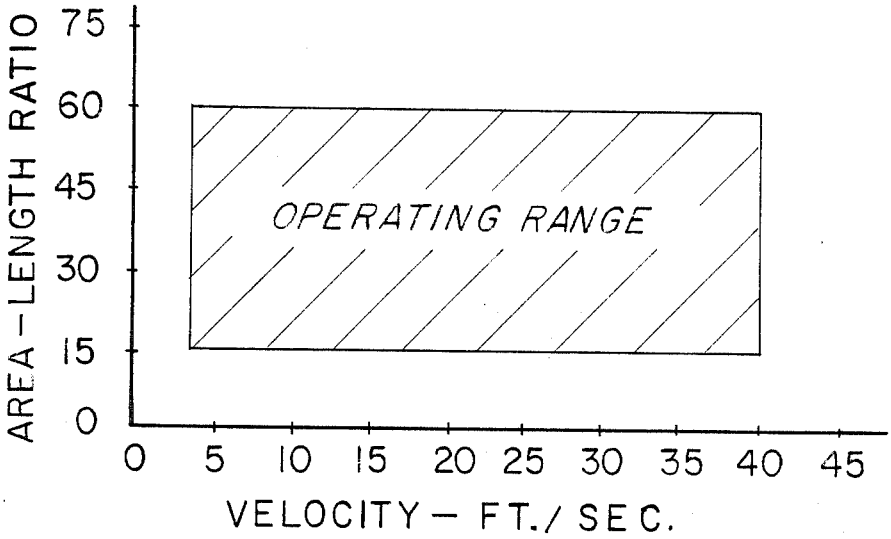
FIG. 7 is a graph plotting the area-length ratio of the passage means against the molten metal velocity.

In order for the process to achieve its stated goals, while being practical to operate within a commercial environment, it is believed that an approximate area to length ratio of heat exchanger tube 22 be utilized in conjunction with an approximate range of liquid metal flow velocities. FIG. 7 is a graphical representation of that relationship, wherein the range of area to length ratios lies between approximatey 15:1 and 60:1, while the liquid metal velocity lies between approximately 4 ft. per sec. and 40 ft. per sec.

Example of 15:1 ratio $1\frac{1}{4}$ in. diameter tube $=0.785\times(1.25)^2=1.227$ in$^2$.
length $=15\times1.227=18.39$ in.

Example of 30:1 ratio 1 in. diameter tube $=0.785\times(1)^2=0.785$ in$^2$.
length $=30\times0.785=23.55$ in.

The liquid metal velocity through tube 22 is defined as that velocity utilizing the full cross-sectional area of the tube, neglecting any restrictions which may be caused by formation of solidified metal on the inner wall of the tube.

In accordance with the invention, means are provided for controlling the velocity of the molten metal through the passage means. As here embodied, the velocity controlling means includes a gas inlet port 26 for applying gas pressure within the vessel 16 through the vessel cap 28. Control valve 30 is connected to the inlet port 26, and a source of pressurized gas 32 is applied through the control valve 30. A sliding gate valve 34 may be interposed between vessel 16 and the flow path 20 for the purpose of opening or blocking the flow passage. This valve 34 may also be used in a partially open position for additionally controlling the liquid metal flow rate. The slide gate 34 is shown in FIG. 1 in the open position and places the flow path 20 in fluid communication with the vessel 16.

In accordance with the invention, cooling means at least partially surrounding the passage means are provided for maintaining the temperature of the molten metal within the passage means between predetermined upper and lower limits. The passage means has a cooled inner surface, and the cooling means removes the superheat and a predetermined portion of the latent heat of fusion from the metal in order to cause partial solidification of the liquid metal passing through the passage means. As here embodied, the cooling means comprises a steel jacket 40 which encloses at least a portion of the flow path 20. The steel jacket 40 has an inlet 42 and an outlet 44 for passing a coolant therethrough. While water is the preferred coolant, various other coolants are also suitable for use with the invention.

In accordance with the invention, the combination of the velocity of molten metal and the area to length ratio within the passage means is for allowing dendrites to grow into the molten core from the cooled inner surface, and for breaking off portions of the dendrites entraining them in the molten metal thereby providing a solids content of the molten metal for subsequent casting.

It is preferred that the cooling means of the invention include a pair of temperature sensing devices, such as thermocouples one being mounted at the entrance and exit of the cooling jacket flow paths, respectively. These temperature sensing devices measure the entrance and exit coolant temperatures for monitoring the amount of heat being dissipated by the molten metal in the device. As here embodied, thermocouples 46 and 48 are mounted at the entrance 42 and the exit 44 of the cooling jacket. The entrance and exit temperatures of the coolant together with the flow rates are utilized to determine the mass energy removal rates from the system.

As shown in FIG. 1, the outlet of the flow path 20 may be connected to the inlet 60 of a suitable mold 62 for receiving the molten metal for subsequent solidification. Molds of various configurations and shapes may be effectively utilized. With a bottom filling mold such as depicted in FIG. 1, a vent 64 is necessary to release residual gas from the mold and allow the mold to be completely filled.

In operation, the apparatus of FIGS. 1 and 2 is initiated by supplying the vessel 16 with a superheated quantity of molten metal. The vessel cap 28 is sealed in place and gas pressure is supplied to the molten metal within the vessel 16. The rate of pressure rise causes the molten metal to flow at a predetermined velocity through the vessel discharge port 36 into the flow path 20 through the gate valve 34.

Coolant is circulated through the cooling jacket 40 at a controlled rate to absorb the energy being dissipated by the solidifying metal. The molten metal flow rate and the area to length ratio are, in combination, the controlling factors which allow solidification to begin adjacent to the cooled inner surface 23 of the flow path 20. The liquid metal entering the flow path 20 will generally be at a superheated temperature. The energy level within the superheat region is relatively low and will be rapidly dissipated, within a short distance of the entrance to the flow path 20. The temperature of the liquid metal rapidly drops to its liquidus point and solidification begins. A portion of the latent heat of fusion is transferred through the cylindrical sleeve 22 and is absorbed by the coolant. The temperature of the coolant is raised in proportion to its flow rate and the quantity of heat being liberated from the solidifying metal. Dendrites begin to grow at the inner surface 23 of the cylindrical sleeve 22. At a given liquid metal flow rate, a shell will form through which the liquid metal will continue to flow. This shell will grow inwardly until an equilibrium condition exists wherein the sweeping effect of the liquid core velocity, removes the newly forming dendrites, entraining them in the liquid stream, and effectively blocks continued inward growth of the shell. Dendrites which subsequently grow from the solidified shell into the flowing liquid stream are broken off and entrained within its flow.

If the quantity of liquid metal were to be increased, its velocity and energy content per unit time would also increase. This causes an imbalance in the heat transfer system, which requires the shell wall to thin out in order to return to an equilibrium condition. It is therefore possible, if the liquid metal velocity is raised to a high enough level, that dendrites could form on the inner surface of the cylindrical sleeve 22 and be swept into the flowing stream with no shell formation at the interface.

It is equally clear that if the liquid metal flow rate is decreased, the shell could thicken to the extent that the passage would close and flow would cease.

The entrained dendrites become nucleation sites for subsequent solidification of the molten metal after it is supplied to a suitable mold.

The molten metal which leaves the system for subsequent casting has a temperature at or below the liquidus temperature of the metal, and contains a percentage of solids. Solidified castings formed from this molten metal exhibit a relatively fine grained microstructure with an absence of undesirable solute segregation and porosity. This improved microstructure results from the solids which have been entrained in the molten metal. These solids act as numerous nucleation sites which promote a fine grained structure during final solidification. Thus, castings produced from metal which has been treated in the apparatus of this invention exhibit a more desirable grain structure and improved metallurgical and mechanical properties.

Although the present invention may be operated manually, it may be desirable for a microprocessor to be utilized for controlling the flow of molten metal and coolant within desired parameters. As shown in FIG. 1, a microprocessor 13 is arranged for receiving temperature data from the thermocouples and pressure data from suitable transducers (not shown), and for controlling the operation of the valve 30.

Figure 5:
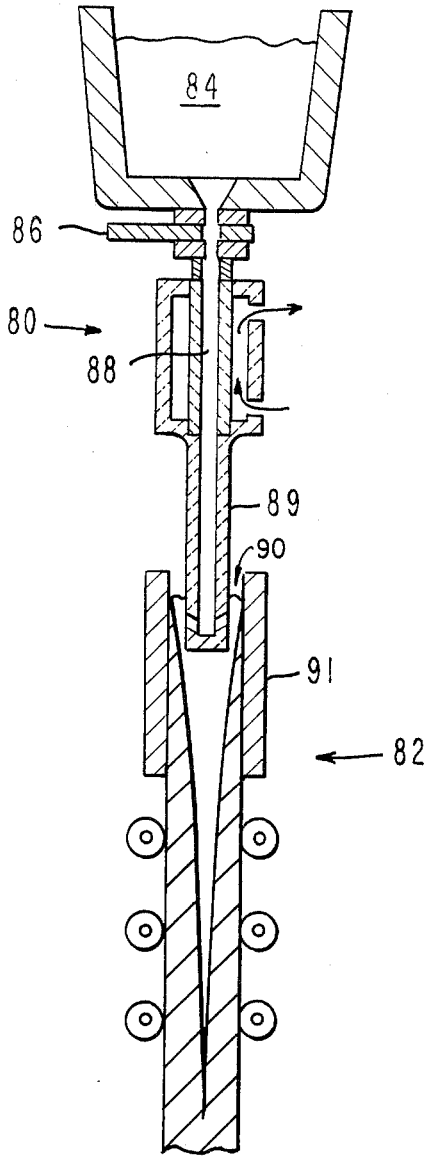
FIG. 5 is a cross-sectional view of an alternative arrangement of the invention for use with a continuous casting apparatus.

FIG. 5 depicts an alternative embodiment of the invention in which the apparatus of the invention, generally designated 80, is employed in combination with a continuous casting apparatus 82. Molten metal is supplied from a source 84 through a gate valve 86 to a heat exchanger 88. The heat exchanger 88 is connected to the input end 90 of the continuous casting apparatus 82.

The heat exchanger 88 removes a portion of the heat from the molten metal and discharges the cooled liquid metal through refractory nozzle 89 into continuous casting mold 91, from which the partially solidified strand is withdrawn. By utilizing the present invention, the resulting casting exhibits a relatively finer grained microstructure with improved properties, as described above.

Figure 4:
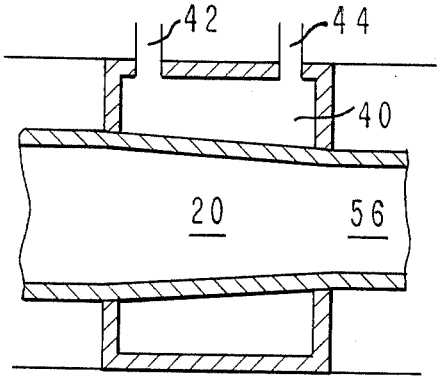
FIG. 4 is a cross-sectional view of another form of the passage and cooling portions of the invention.

Various modifications to the configuration of the metal flow path 20 may be made to alter the velocity and dynamics of the molten metal flow. For example, the cross-sectional area of the flow path 20 may be modified as shown in FIG. 4 to vary the flow velocity of the molten metal. As shown, the flow path 20 may be constricted at one end to increase the velocity of the exiting molten metal.

Figure 3:
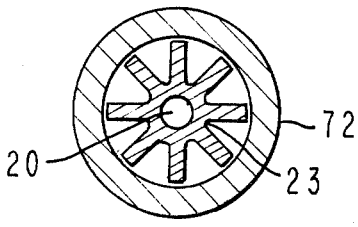
FIG. 3 is a sectional view of the passage portion of the invention showing the fins, taken along line 3—3 in FIG. 2.

As shown in FIG. 3, a plurality of cooling fins 72 may be provided on the outer surface of the copper tube to increase the surface area in contact with the coolant.

Figure 6:
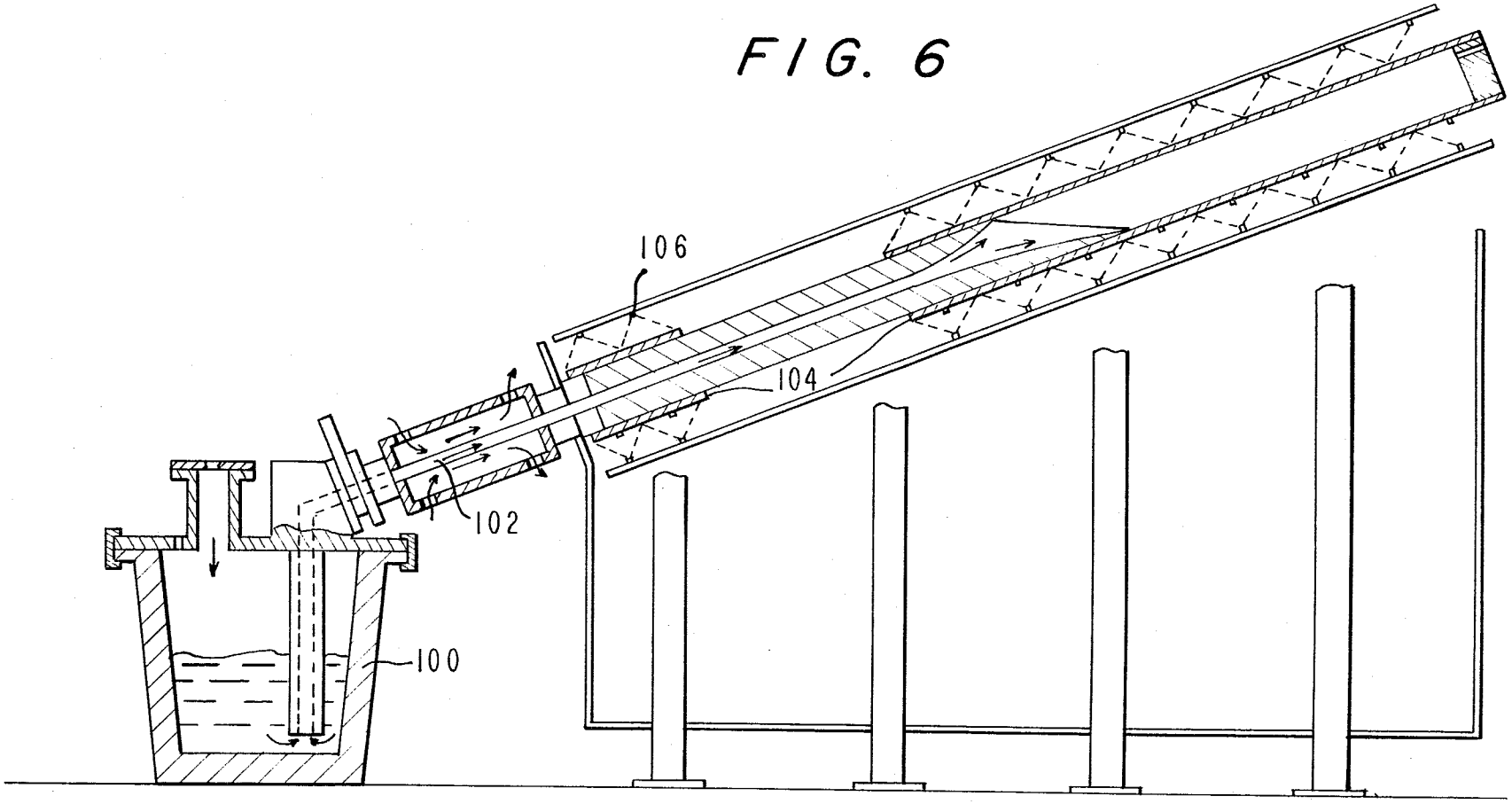
FIG. 6 is a sectional view of one particular application of the invention.

In FIG. 6 another application of the invention is shown with a bottom filled inclined mold, as described in U.S. Pat. No. Re 30,979, which disclosure is incorporated by reference herein. In this embodiment, molten metal is supplied to a vessel 100, and is forced by gas pressure through the liquid metal flow path 102. The flow path 102 is identical to that depicted in FIG. 1, except that the entire assembly is inclined and connected to a consummable mold 104. The structure and operation of mold 104 is fully disclosed in U.S. Pat. No. Re 30,979, and includes a cooling mechanism 106 for spraying water onto the mold 104 as the molten metal is solidifying. The advantages achieved by the use of this structure, as disclosed in the referenced prior patent, are further enhanced by the addition of the present invention to that structure, as shown in FIG. 6.

In accordance with the invention, the method for producing a solids content within a molten metal comprises the steps of flowing superheated molten metal at a controlled velocity through a passage of predetermined size and length, and cooling the passage at a controlled rate for forming a thin solidified shell having a molten core within the passage, the combination of the velocity of molten metal and the cooling rate for allowing dendrites to grow into the molten core from the solidified shell, and for breaking off at least portions of the dendrites and entraining them in the molten metal thereby providing a solids content within the liquid metal for subsequent casting.

As an example of the invention, an experimental prototype was constructed and operated within an iron foundry producing complex sand castings of various iron alloys.

Alloys, such as type I Ni-Hard were delivered to the machine from a conventional transfer ladle. Approximately 350 lbs. were decanted into the vessel for subsequent conditioning and casting into sand molds. The heat exchanger portion of the device was 12 inches in length and had a $\frac{7}{8}$ inch diameter bore. The outlet end of the heat exchanger was connected to both single and multiple sand molds with cavities of up to 300 lbs. capacity. Argon gas, supplied under pressure and controlled by an electronically driven gas servo-valve, was delivered to the surface of the liquid metal within the vessel for the purpose of providing the energy to force the liquid metal through the heat exchanger, at a controlled rate.

Normally, the sand molds would be provided with risers, for the purpose of feeding liquid metal during solidification in order to eliminate shrinkage voids. Under conventional operating conditions, castings produced without risers would be highly porous and unacceptable for commercial use. Molds used during operation of the experimental prototype were not equipped with risers.

Castings produced during early experiments, wherein the area to length ratios and liquid metal velocities fell outside the boundaries as defined in FIG. 7, had severe surface shrinkage, large internal voids and other shrinkage related defects. When operating parameters were adjusted to fall within the ranges as defined in FIG. 7, the castings thus produced had no surface shrinkage or internal voids. In addition, the grain structure was observed to be considerably finer than was produced in earlier experiments.

Operating Parameters

Heat exchanger diameter—$\frac{7}{8}$ inch
Heat exchanger length—12 inches
Cooling water flow rate—170 gal./min.
Metal to be cast—Ni-Hard, type I
Casting temperature—2280° F. to 2350° F.
Liquid metal velocity—5.7 to 7.2 ft./sec.
Heat exchanger area to length ratio—19.97:1

It is conceivable that there may be circumstances in which it is desirable for the casting temperature to be at or above liquidus. In such a case the heat exchanger will act more as a temperature controller than as a device for producing a solids content within a flowing stream.

It has been previously stated in this application that dendrites which have formed at the solid-liquid interface are entrained within the flowing stream and will not remelt, since no superheat is available. That statement is based upon what is considered to be at this time, a reasonable description of a simple single phase alloy system, solidifying in a dynamic environment. Except for ultra-pure metals, produced under highly specialized conditions, micro-solidification at the dendritic level is more complex than the description previously given.

Present technology is such that compositional quantification of a single dendrite can only be studied after solidification of the entire mass has taken place. It is therefore not possible at this time to accurately describe the compositional dynamics of single dendrite growth during solidification. Since the melting and freezing points of a metallic solution are directly related to its composition, only the most general statements can be made in regard to the thermodynamics of micro-solidification.

It is therefore possible that a dendrite may form at a solid-liquid interface, be swept into a flowing stream and not remelt, despite the fact that the temperature of the stream was above liquidus. This situation could occur if the composition of the dendrite, at this particular stage, was such that its melting point was above that of the surrounding liquid.

This postulation is offered as a possible explanation for unexpected results which were encountered when operating the experimental casting device described herein.

A simple mathematical model was developed for the purpose of estimating the percentage of solids in the exiting stream of the heat exchanger. Data taken from early experiments, when used in conjunction with the mathematical model, indicated that only a portion of the superheat had been removed and that there was no solids content within the stream. Castings made under these conditions exhibited severe shrinkage problems, but the grain structure was finer than would have been achieved by conventional casting.

Later experiments, with adjustments in the operating conditions, indicated via the mathematical model, that a greater amount of superheat had been removed, but still predicted mathematically that no solids were flowing within the exit stream. However, the castings produced under these latter conditions did not have shrinkage defects and exhibited comparatively finer grain structure. These results are considered remarkable when viewed from the perspective of present knowledge.

As is apparent, the apparatus and method of the present invention is suitable for treating and processing most conventional molten metals to provide a solids content in the molten metal for subsequent casting. While the invention has been described with relation to certain illustrated embodiments it will be apparent those skilled in the art that various modifications and variations could be made in the invention without departing from the scope or spirit of the invention.

I claim:

1. A molten metal treatment apparatus comprising:

passage means having a predetermined area to length ratio for receiving superheated molten metal from a source thereof, and for supplying said molten metal for subsequent casting;

means for controlling the velocity of said molten metal through said passage means within predetermined limits defined in combination with the area to length ratio of the passage means by the hatched area of the graph as shown in FIG. 7;

cooling means at least partially surrounding said passage means for controlling the temperature of said molten metal within said passage means between predetermined upper and lower limits for forming a thin solidified shell having a molten metal core with said passage means;

the combination of said velocity of molten metal and said temperature of said molten metal within said passage means for allowing dendrites to grow into said molten core from said solidified shell, and for breaking off portions of said dendrites and entraining them in said molten metal thereby producing a solids content within said molten metal for subsequent casting.

2. The apparatus of claim 1 wherein said passage means includes an inlet port and an outlet port and said velocity controlling means includes valve means for regulating the flow of molten metal through said outlet port.

3. The apparatus of claim 2 wherein said passage means includes a copper tube.

4. The apparatus of claim 3 wherein said copper tube includes a plurality of radially extending fins on the outer surface thereof for enhancing heat transfer from said copper tube.

5. The apparatus of claim 3 wherein said cooling means includes a steel jacket surrounding said copper tube, said jacket for circulating coolant about said copper tube, said jacket having an entrance and an exit for said coolant.

6. The apparatus of claim 5 wherein said cooling means includes a pair of temperature sensing devices, one of said devices being mounted at the entrance and exit of said jacket respectively, for measuring the entrance and exit coolant temperatures.

7. A method for producing a partial solids content within a molten metal stream for subsequent casting, comprising the steps of:

flowing molten metal at a controlled velocity through a passage having a predetermined area to length ratio, the combination of the velocity of the molten metal and the area to length ratio of the passage being defined by the hatched area of the graph as shown in FIG. 7; and cooling said passage at a controlled rate for forming dendrites at the passage inner surface;

the combination of said velocity of molten metal and said cooling rate for allowing said dendrites forming at said passage inner surface to be entrained in said molten metal, thereby producing a partial solids content within said molten metal for subsequent casting.

8. The method of claim 7 wherein the temperature of molten metal exiting said passage is maintained at or below liquidus temperature of said metal.

9. The method of claim 8 wherein said molten metal from said passage is supplied under pressure to a mold.

* * * * *